US006915905B2

(12) United States Patent
Yoshimura

(10) Patent No.: US 6,915,905 B2
(45) Date of Patent: Jul. 12, 2005

(54) PACKING BUFFER MATERIAL

(75) Inventor: Naomi Yoshimura, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/276,038

(22) PCT Filed: Mar. 13, 2002

(86) PCT No.: PCT/JP02/02358

§ 371 (c)(1),
(2), (4) Date: Apr. 14, 2003

(87) PCT Pub. No.: WO02/072447

PCT Pub. Date: Sep. 19, 2002

(65) Prior Publication Data

US 2003/0165659 A1 Sep. 4, 2003

(51) Int. Cl.[7] ..... B65D 81/02
(52) U.S. Cl. ..... 206/586; 206/587; 206/592
(58) Field of Search ..... 206/586, 453, 206/557, 558–592, 521, 459.5

(56) References Cited

U.S. PATENT DOCUMENTS 2,863,595 A * 12/1958 Emery ..... 229/406
4,483,444 A * 11/1984 Gardner ..... 206/594
4,838,427 A * 6/1989 Hurley ..... 206/566
4,860,894 A * 8/1989 Koenig ..... 206/421
5,154,297 A * 10/1992 Farley ..... 206/599
5,678,692 A * 10/1997 Gratz ..... 206/453
5,715,940 A * 2/1998 Son ..... 206/320
5,769,233 A * 6/1998 Fredriks ..... 206/523
RE37,253 E * 7/2001 Moren et al. ..... 206/566
6,340,087 B1 * 1/2002 Bridges et al. ..... 206/523
6,382,422 B1 * 5/2002 Bocek ..... 206/586
6,405,873 B2 * 6/2002 Koike ..... 206/592
6,629,608 B2 * 10/2003 Hurley et al. ..... 206/586
6,820,743 B2 * 11/2004 Hurley et al. ..... 206/427

* cited by examiner

*Primary Examiner*—Shian T. Luong
(74) *Attorney, Agent, or Firm*—Jay H. Maioli

(57) ABSTRACT

A packing cushion material located between a packing article and a packing box to buffer shocks applied from the outside to protect electronic appliances such as audio apparatus and speaker apparatus and other articles housed and packed in the packing box is formed by pulp mold. The packing cushion material is characterized by upper and lower cushion portions contacting with the packed article from the lower direction or the upper direction and side cushion portions contacting with the packed article from the lateral direction to receive force acting from the lateral direction, wherein the side cushion portions include protrusion portions protruding in the upper and lower directions and including contact surfaces expanded in the upper and lower directions to surface-contact the packed article and reinforcement portions formed at the rear sides of the protrusion portions and having concave and convex portions.

7 Claims, 12 Drawing Sheets

PACKING BUFFER MATERIAL

TECHNICAL FIELD

The present invention relates to packing cushion materials disposed between a packed article and a packing box to buffer shocks applied from the outside to thereby protect the packed article when electronic appliances such as audio apparatus, television receiver and speaker apparatus and other articles are housed and packed within packing boxes, and particularly to a packing cushion material formed by pulp molding and which includes contact surfaces for supporting a packed article by a wide area to thereby protect the packed article from shocks applied to the packing box.

BACKGROUND ART

Foam polystyrene molded materials molded by foam polystyrene have been available as packing materials for packing electronic appliances such as audio apparatus and television receiver and foods such as vegetables, fruits and fish. Because the foam polystyrene molded materials are light in weight and are relatively high in strength, a large amount of foam polystyrene molded materials have been used as cushion materials and packing containers. Although the foam polystyrene molded materials are excellent materials as cushion materials and packing containers as described above, there have occurred various problems when they are wasted after they had been used.

For example, when foam polystyrene is burned up, it is burned up to produce intense heat which as a result damages an incinerator. Moreover, when foam polystyrene is directly buried into soils for disposal, since foam polystyrene cannot be decomposed it does not transform into soil. There arises a problem that foam polystyrene still remains in the soils.

From a viewpoint of protecting environments from being polluted and from a standpoint of how to effectively utilize natural resources, as substitutes for foam polystyrene, there have recently been developed cushion materials and packing containers formed by pulp molding using wasted papers such as newspapers and magazines as main raw materials. As a packing cushion material using such pulp mold, there is proposed a packing pad molded body that is disclosed in FIGS. 2 and 3 of Japanese laid-open patent application No. 11-278551, for example. FIGS. 2 and 3 of the official gazette of the above patent application are referred to as FIGS. 15 and 16.

As shown in FIGS. 15 and 16, this packing pad molded body 1 is used to fix a packed item, for example, a lighting apparatus comprising a lighting apparatus main body 2 and a shade 3 within a packing box 4 and is formed of pulp mold which is integrally formed by mold die. A bending portion 5 having a V-like cross-section is disposed at substantially the central portion of the packing pad molded body 1 such that the bending portion can freely bend inwardly or outwardly and a contact portion 7 comprising a curved portion or contact rib corresponding to the side shape of the shade 3 is provided on one surface 6 of the bending portion 5.

A projection edge portion 10 includes a holding portion 9 that can inwardly bend to hold an end edge 8 of the lighting apparatus main body 2 at its tip end and projects from the contact portion 7 at its portion near the bending portion 5. At the same time, a recess portion 13 for supporting a supporting portion 12 of the lighting apparatus main body 2 at its end edge is provided on the other surface 11, and a holding groove 16 that holds a projection rib edge 14 of the lighting apparatus main body 2 is formed on the other surface.

Besides, an engagement portion 16 is formed on the opposing surface of the bending portion 5 in order to engage the opposing surface when they are brought in close contact with each other. Reference numeral 17 denotes a reinforcement rib provided on the other surface 11.

According to this packing pad molded body 1, after the packing pad molded bodies are located at the corners of the packing box 4, the shade 3 is held on the packing pad molded bodies and then held and fixed by the projection edge portion 10 formed on one surface 6. Consequently, within the packing box 4, the shade 3 can be prevented from being rickety and shocks applied to the lighting apparatus within the packing box can be buffered, thereby making it possible to prevent the lighting apparatus from being damaged.

However, in this conventional packing cushion material, there arises a problem that performances needed by this kind of cushion materials cannot be satisfied satisfactorily. Specifically, packing cushion materials are generally examined by a vibration test for testing how much vibrations are buffered and transmitted to the packed article as external input and a drop test for testing how much impact strength are buffered and transmitted to the packed article as external input when the packed article is dropped. Manufacturers of packing cushion materials usually judge the results of the tests according to their own standards and use their products that can satisfy their own standards.

In this case, since a conventional packing cushion material has the structure in which the contact portion 7 is provided on one surface 6 which the side surface of the shade 3 contacts and the reinforcement rib 17 is provided on the other surface 11, in order for the packing cushion material to have sufficient cushion function against the drop test, the contact portion 7 and the reinforcement rib 17 have to increase their rigidity so that the packing cushion material becomes able to sufficiently absorb shocks applied when the packed article is dropped.

When, however, the rigidity of the contact portion 7 and the reinforcement rib 17 is increased, linear protrusion portions of the contact portion 7 and the reinforcement rib 17 support the shade 3 and the lighting apparatus main body 2 and thereby the shade and the lighting apparatus main body come into linear contact with each other. As a result, in the drop test, when the surfaces of the shade 3 and the lighting apparatus main body 2 are coated with paint, there arises a problem that paint tends to easily peel off due to shocks from the contact portion 7 and the reinforcement rib 17.

In the case of the vibration test, when the contact portion 7 and the reinforcement rib 17 are large in rigidity, the contact portion 7 and the reinforcement rib 17 that form the linear contact rub against the surfaces of the shade 3 and the lighting apparatus main body 2, the paints on the shade 3 and the lighting apparatus main body 2 will be damaged easily. Although the receiving surfaces of the contact portion 7 and the reinforcement rib 17 have to increase in space to receive the shade 3 and the lighting apparatus main body 2 with wider areas in order to protect the paint from being damaged, sufficiently large reception surfaces could not be maintained.

Therefore, in order to obtain a sufficiently large cushion capability by using the conventional cushion material made by pulp mold while maintaining their wide areas in contact with the lighting apparatus main body 2 and the shade 3, the thickness of the pulp mold has to increase and the length of the cushion portion has to increase. As a consequence, the cushion material is caused to increase its weight and is also caused to become large in size so that not only the amount of pulp mold to be used increases but also the whole of the packing form becomes large in size inevitably.

In view of the aforementioned problems encountered by the prior art, it is an object of the present invention to provide a packing cushion material which can be molded by pulp mold of a relatively small amount. Although this packing cushion material is small, this packing cushion material can demonstrate a large buffering capability and can protect packed articles softly and can prevent paint from peeling off from the packed article and can prevent the packed article from being damaged.

DISCLOSURE OF INVENTION

According to the present invention, there is provided a packing cushion material formed by pulp mold and a plurality of packing cushion materials are located around a packed article within a packing box to buffer external force applied to the packed article to thereby protect the packed article. This packing cushion material is characterized by upper and lower cushion portions contacting with the packed article from the lower direction or the upper direction to support the packed article from the lower direction or located over the packed article from the upper direction to receive force acting from the upper and lower directions and side cushion portions contacting with the packed article from the lateral directions to receive force acting from the lateral direction, wherein the side cushion portions comprise protrusion portions protruding in the upper and lower directions and including contact surfaces expanded in the upper and lower directions to surface-contact the packed article and reinforcement portions formed at the rear sides of the protrusion portions and having concave and convex portions.

BRIEF DESCRIPTION OF DRAWINGS

FIG. 8 show the cushion material combined assembly in which 8 kinds of packing cushion materials are integrally molded according to the present invention, wherein

FIG. 9 show the cushion material combined assembly in which 8 kinds of packing cushion material are integrally molded according to the present invention, wherein

FIG. 10 show a reinforcement portion and a reinforcement rib according to another embodiment of the present invention, wherein

FIG. 11 show a reinforcement portion and a reinforcement rib according to a further embodiment of the present invention, wherein

BEST MODE FOR CARRYING OUT THE INVENTION

Figure 1:
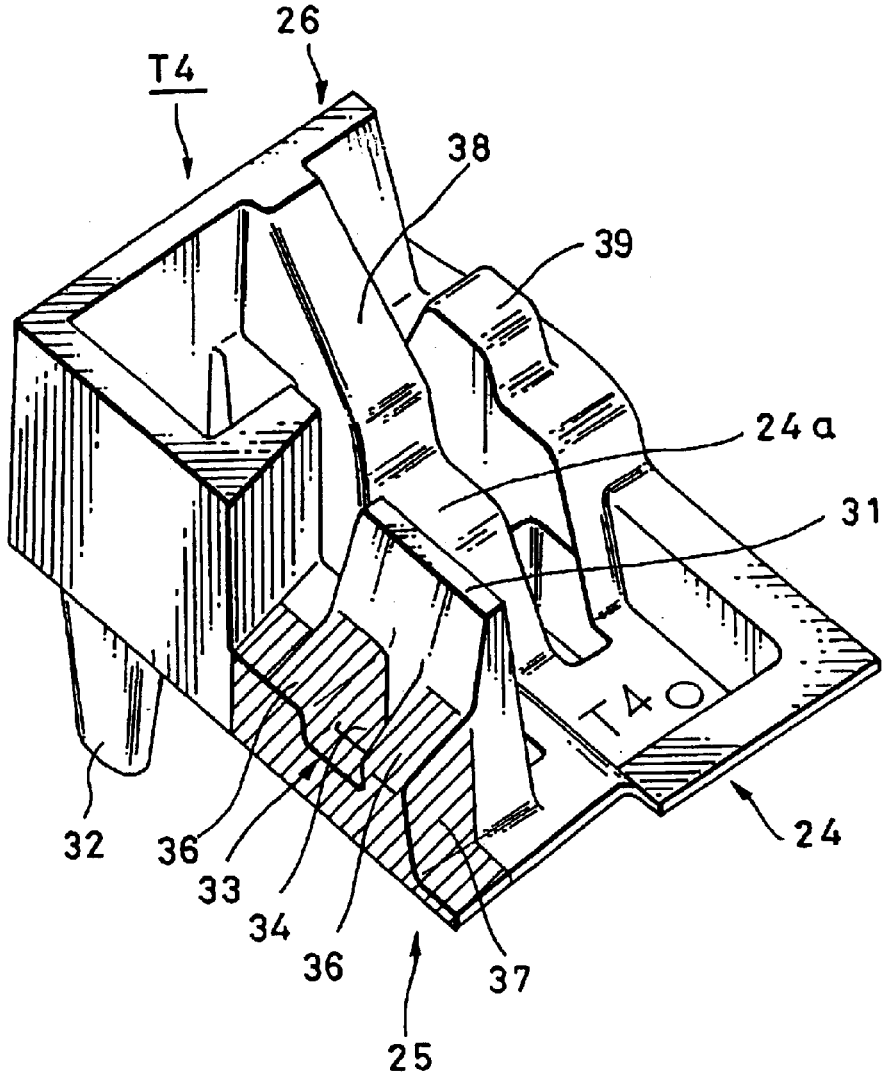
FIG. 1 is a perspective view showing a packing cushion material according to a first embodiment of the present invention and illustrates the packing cushion material from one of the front in which a packed article is housed.

Embodiments of the present invention will be described below with reference to the accompanying drawings. FIGS. 1 to 14 show a packing cushion material according to embodiments of the present invention.

Packing cushion materials according to the present invention are produced by pulp molding using pulps including waste papers such as papers of newspapers, corrugated cardboards or magazines and are generally referred to as pulp mold molded assemblies. A manufacturing process of packing cushion materials uses a material supply tank for supplying pulp materials, a male die for attaching pulp materials by sucking pulp materials supplied to this tank at a fixed pressure and a female die for supplying pulp molds into a drying furnace after it receives pulp molds from the male die. Then, a molding machine laminates pulp materials up to a predetermined thickness on a net-like molding surface by its sucking force. Thus, there can be manufactured packing cushion materials that are shaped like shells on the whole.

Packing cushion materials according to the present invention can be manufactured by a method other than this method. For example, the packing cushion materials according to the present invention can be manufactured by a molding metal mold for manufacturing pulp molds concerning packing cushion materials and a compression molding apparatus for compressing pulp materials within this metal mold to mold the pulp materials into predetermined shapes.

FIG. 7, FIGS. 8A to 8C and FIGS. 9A to 9D show specific examples of a cushion material combined assembly 20 manufactured by the above-mentioned molding machine. The cushion material combined assembly 20 comprises totally 8 pieces of packing cushion materials T1 to T4 and B1 to B4 of four top cushion materials T1, T2, T3 and T4 and four bottom cushion materials B1, B2, B3 and B4 that are integrally molded.

The four top cushion materials T1 to T4 are respectively attached to four corners of the top portions of a packed item that is an object to be packed when in use. To this end, the four top cushion materials T1 to T4 are collectively located on one side of the longitudinal direction R corresponding to the positions for use in such a manner that their front surfaces may oppose to each other.

Similarly, the four bottom cushion materials B1 to B4 are respectively attached to the four corners of the bottom portions of a packed item that is an object to be packed when in use. To this end, the four bottom cushion materials B1 to B4 are collectively located on the other side of the longitudinal direction R corresponding to the positions for use in such a manner that their front surfaces may oppose to each other.

As described above, in certain specific portions (top portions and bottom portions of packed article in this embodiment) of the packed article, the four top cushion materials T1 to T4 for use in top portions and the four bottom cushion materials B1 to B4 for use in bottom portions are collectively disposed as pairs and integrally molded as described above, whereby combinations of cushion materials comprising respective pairs can be made clear to users. Therefore, the portions at which the respective cushion materials T1 to T4 and B1 to B4 can be used can be made clear to users in advance so that the cushion materials T1 to T4 and B1 to B4 can be prevented from being attached incorrectly.

Further, since the eight packing cushion materials T1 to T4 and B1 to B4 of respective pairs are disposed in the same states as in the states in which they are in use, upon packing, the layouts of the respective cushion materials T1 to T4 and B1 to B4 need not be considered and these cushion materials can be used while their places are specified mechanically. Accordingly, there can be removed a risk that the respective cushion materials T1 to T4 and B1 to B4 will be located at incorrect places.

Further, since the eight packing cushion materials T1 to T4 and B1 to B4 have identification marks (e.g. T1 to T4 and B1 to B4) attached thereto, places in which respective cushion materials are in use can become clear based upon the identification marks. Therefore, the users can put the respective cushion materials at the designated places with ease rapidly and workability in the packing process can improve.

Figure 7:
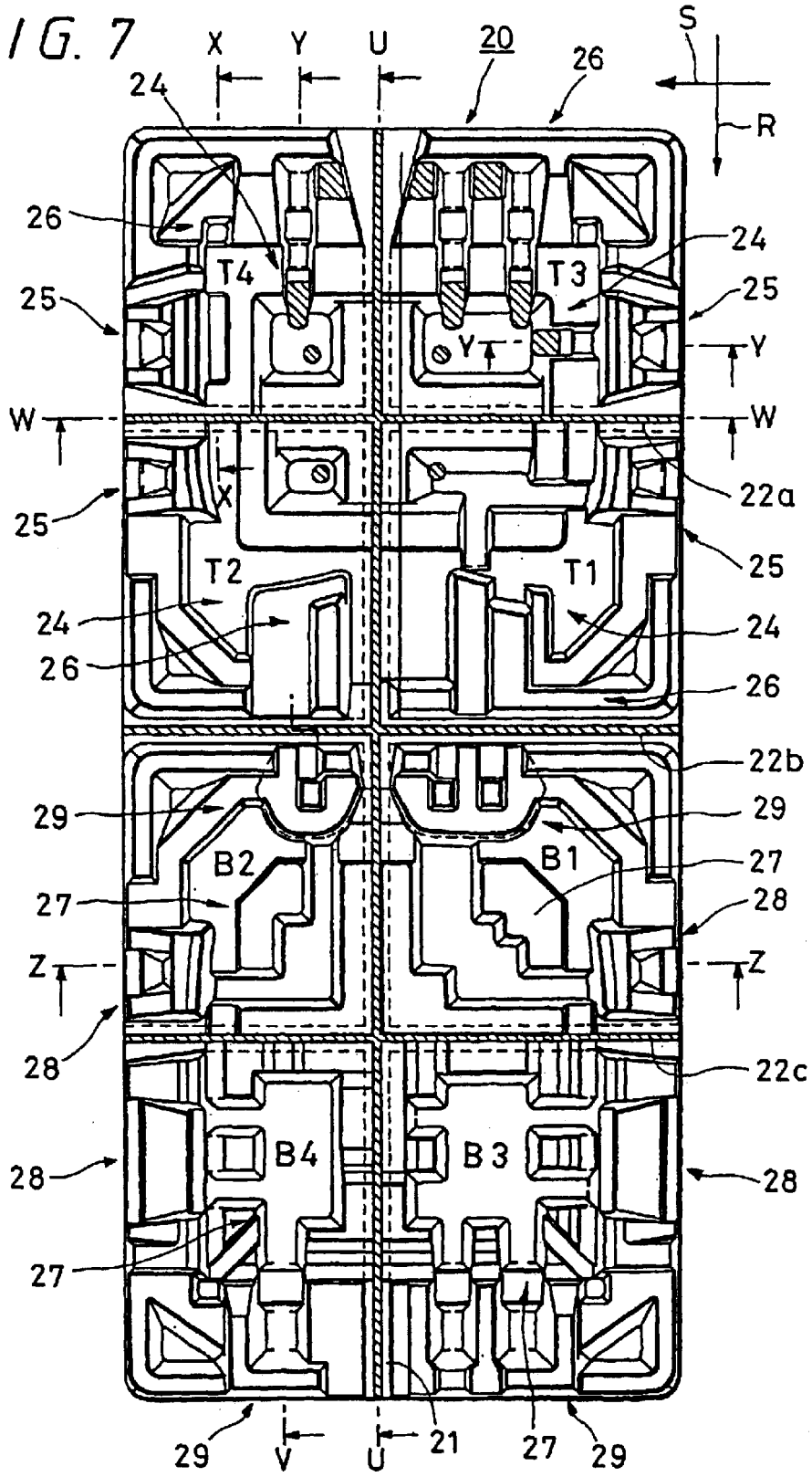
FIG. 7 is a plan view showing a cushion material combined assembly in which 8 kinds of packing cushion materials are integrally molded according to the present invention.
Figure 8A:
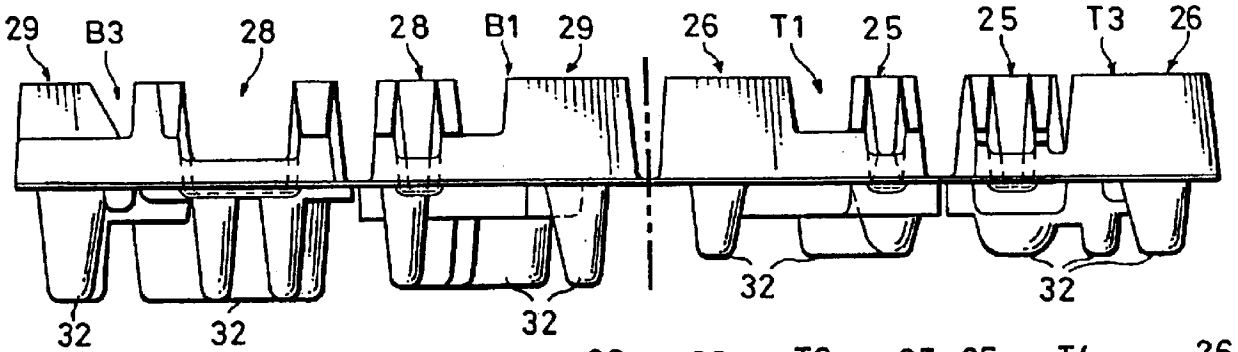
FIG. 8A is a front view thereof.
Figure 8B:
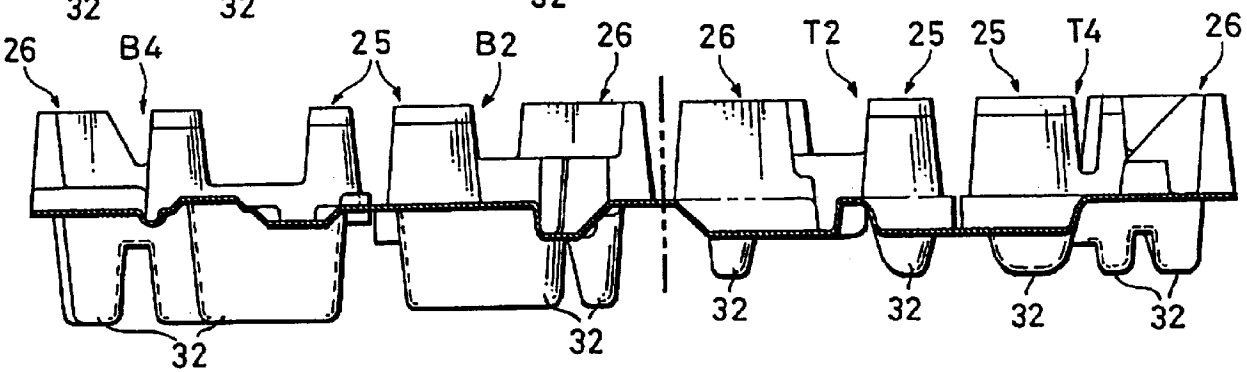
FIG. 8B is a cross-sectional view taken along the line U—U in FIG. 7
Figure 8C:
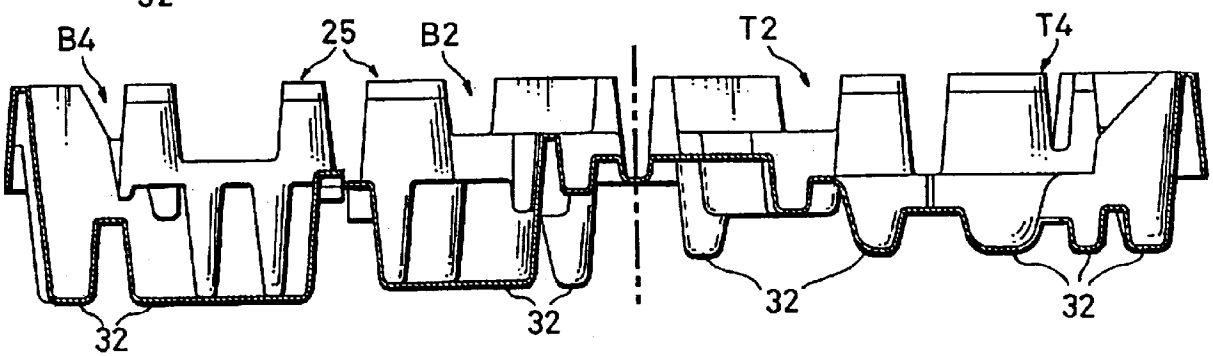
FIG. 8C is a cross-sectional view taken along the line V—V in FIG. 7.

The eight packing cushion materials T1 to T4 and B1 to B4 are separated, as shown by hatches in FIG. 7, by a vertical line 21 passing vertically through substantially a central portion of a width direction S perpendicular to the longitudinal direction R of the cushion material combined assembly 20 and three horizontal lines 22*a*, 22*b* and 22*c* extending in the horizontal direction to thereby divide the longitudinal direction R into four. The cushion material combined assembly 20 may be divided by half in the longitudinal direction R in advance and the four top cushion materials T1 to T4 and the four bottom cushion materials B1 to B4 may be molded independently.

Further, although the eight packing cushion materials T1 to T4 and B1 to B4 are different in shapes when they are seen in detail, as shown in FIGS. 8A to 8C and FIGS. 9A to 9D, their essential arrangements are all similar. Specifically, the four top cushion materials T1 to T4 include upper cushion portions 24 that show specific examples of upper and lower cushion portions for receiving external force acting from above when they contact with the upper surface of a cube-like packed article after they are attached to the upper corner portion of the packed article and first and second side cushion portions 25, 26 for receiving external force acting from the lateral direction when they contact with the side surfaces of the upper corner portions of the packed article. The upper cushion portion 24 and the first and second side cushion portions 25, 26 comprise combinations of proper concave and convex portions and can change in shape such that they may compress themselves against external force acting thereon from above or side in response to magnitude of external force to absorb or buffer external force.

Similarly, the four bottom cushion materials B1 to B4 comprise lower cushion materials 27 showing other specific examples of upper and lower cushion portions that contact the lower surface of a cube-like packed article to upwardly support the packed article after they are attached to the lower corner portions of the packed article and which receive external force acting from the underside and first and second side cushion portions 28, 29 that contact with the side surfaces of the lower corner portions of the packed article to receive external force acting from the side direction. The lower cushion portions 27 and the first and second side cushion portions 28, 29 comprise combinations of proper concave and convex portions and can change in shape such that they may compress themselves against external force acting from the underside or the side direction in response to the magnitude of external force to absorb or buffer external force.

Next, arrangements of the typical packing cushion materials T4, T3 and B2 of the above-mentioned packing cushion materials T1 to T4 and B1 to B4 will be described in detail with reference to FIGS. 1 to 6.

Figure 2:
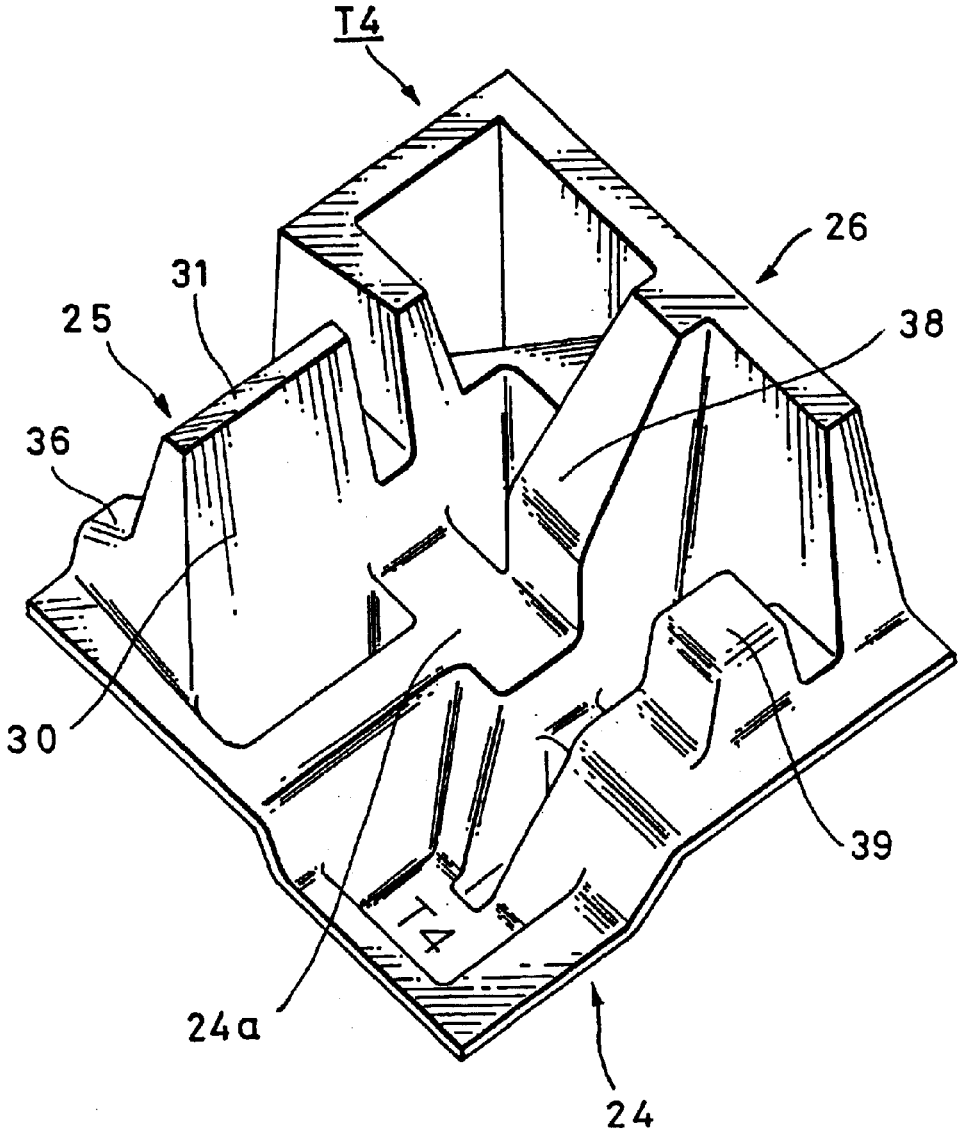
FIG. 2 is a perspective view showing a packing cushion material according to a first embodiment of the present invention and illustrates the packing cushion material from the other side of the front in which a packed article is housed.

FIGS. 1 and 2 show the fourth packing cushion material T4 of the top cushion materials T1 to T4 and illustrate the front side that contacts with the packed article in two directions. Specifically, as shown in FIG. 2, one portion of the upper corner portions of the packed article is attached to the central portion of the fourth packing cushion material, the upper lid of the packing box is opposed to the lower surface, not shown, and the side surface of the packing box is opposed to the back side (rear surface side) similarly not shown.

The fourth packing cushion material T4 comprises an upper cushion portion 24 including a top surface 24*a* that contacts with the upper surface of the packed article, a first side cushion portion 25 continuing to one side of this upper cushion portion 24 and which includes a protrusion portion 31 and a second side cushion portion 26 disposed at the position rotated by 90 degrees in the clockwise direction relative to the first side cushion portion 26 and which continues to the other side of the upper cushion portion 24. The top surface 24*a* of the upper cushion portion 24 may be shaped freely so long as it has a flat surface that can contact with the upper surface of the packed article. Further, the upper cushion portion 24 includes a plurality of leg portions 32 downwardly projecting on the inside of the top surface 24*a* and the lid of the packing box contacts with tips of these leg portions 32.

Figure 9A:
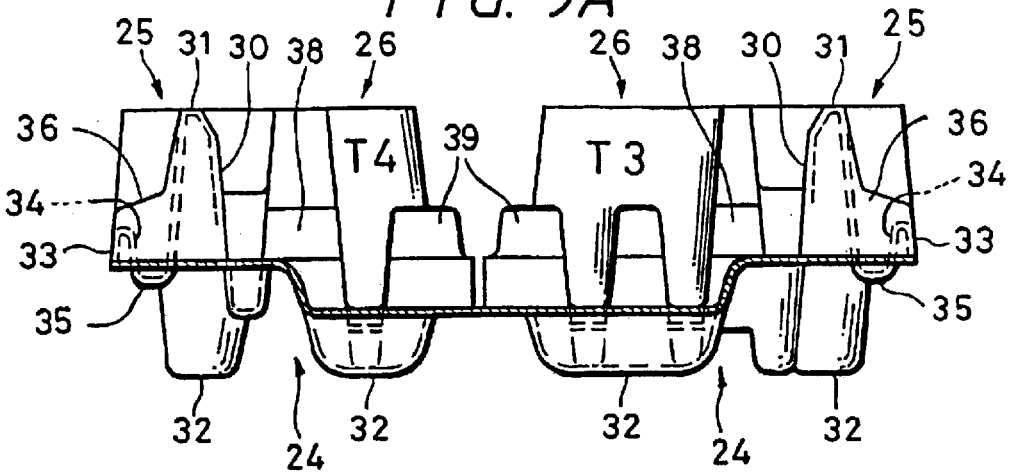
FIG. 9A is a cross-sectional view taken along the line W—W in FIG. 7.

The protrusion portion 31 of the first side cushion portion 25 erects on one side of the upper cushion portion 24 and the surface of the side that contacts with the packed article forms a contact surface 30 comprising a flat surface so that it can contact with the side surface of the packed article in a wide range. The protrusion portion 31 has a reinforcement portion 33 formed at its rear side and the reinforcement portion 33 includes a recess portion 34 which shows a first specific example of concave and convex portions. This recess portion 34 comprises the protrusion portion 31 and a cylindrical thick portion 35 formed on the rear side of the protrusion portion as shown in FIG. 9A.

Further, the protrusion portion 31 has at its rear side a reinforcement rib 36 that is formed by slightly bulging out its root portion. A transformation area 37 shown hatched in FIG. 1 is a portion that can change in shape like contracting in response to external force acting on the side surface thereof from the lateral direction in an accident such as when the packed article is dropped unintentionally. When the transformation area 37 compresses itself in response to external force, such external force is transformed into thermal energy, whereby shocks can be absorbed and cushion function can be demonstrated sufficiently.

On the other hand, since the protrusion portion 31 which serves as the inside of the transformation area 37 is formed as a wall whose shape is difficult to collapse, the protrusion portion 31 can receive the packed article stably and it is possible to prevent external force from being directly transmitted to the packed article. In addition, since the area of the contact surface 30 that contacts with the packed article is large, vibrations transmitted to the packed article can be attenuated effectively. As a result, paints can be prevented from being peeled off from the surface of the packed article and the surface of the packed article can be prevented from being scratched.

The second side cushion portion 26 includes a rib portion 38 and a convex portion 39 that can position the packed article. The rib portion 38 and the convex portion 39 are set to be low so that their contact surfaces can contact with the lower portion of the packed article. Thus, the packed article can be reliably supported at the predetermined position.

Figure 3:
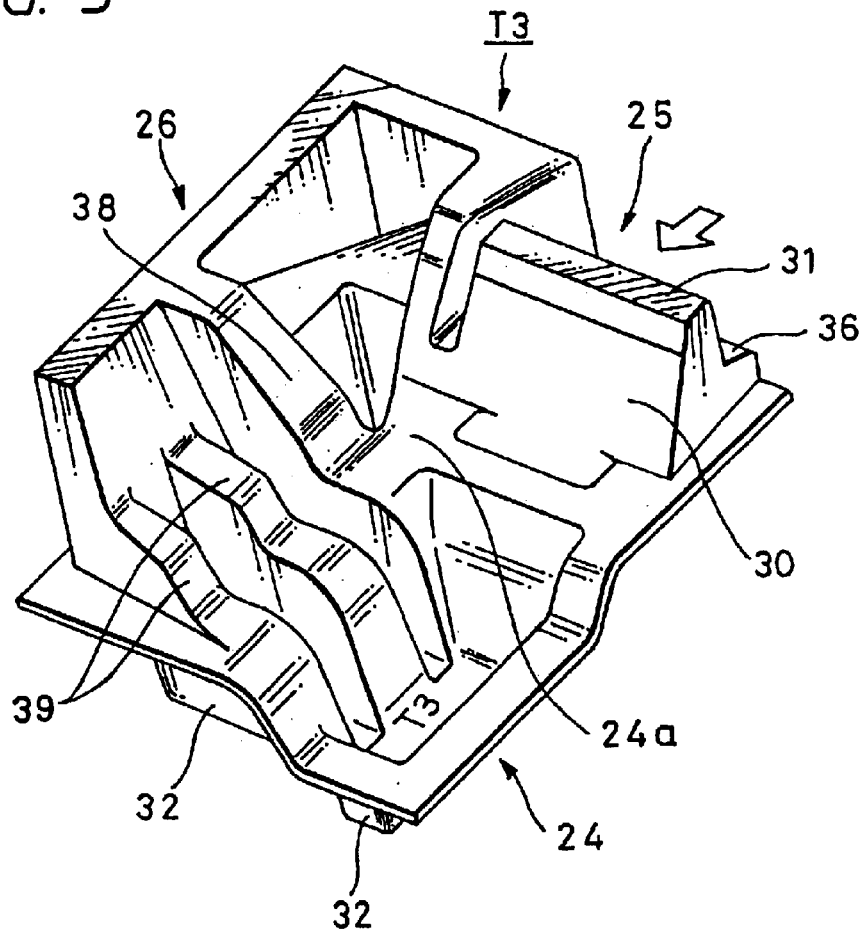
FIG. 3 is a perspective view showing a packing cushion material according to a second embodiment of the present invention and illustrates the packing cushion material from one of the front in which a packed article is housed.
Figure 4:
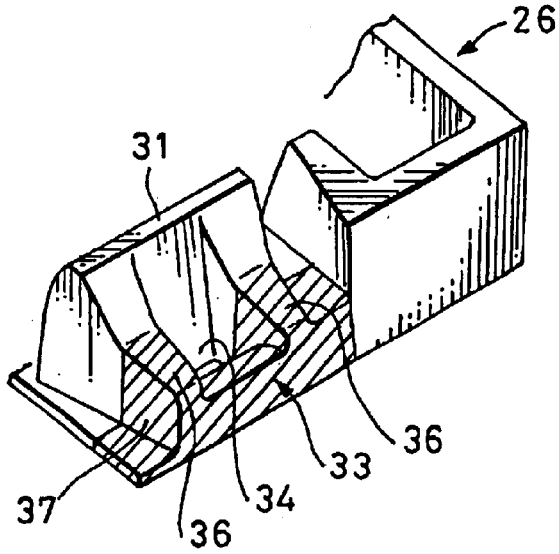
FIG. 4 is a perspective view showing a main portion of a packing cushion material according to a second embodiment of the present invention and illustrates a protrusion portion shown in FIG. 3 from the rear side.

The third packing cushion material T3 shown in FIGS. 3 and 4 has a similar arrangement to that of the above-mentioned fourth packing cushion material T4 and includes the upper cushion portion 24 including the top surface 24*a* that contacts with the upper surface of the packed article, the first side cushion portion 25 continuing to one side of the upper cushion portion 24 and which includes the protrusion portion 31 and the second side cushion portion 26 located at the position rotated by 90 degrees in the counter-clockwise direction relative to the first side cushion portion 25 and which continues to the other side of the upper cushion portion 24. The top surface 24*a* of the upper cushion portion 24 may be shaped freely so long as it has a flat surface that can contact with the upper surface of the packed article. Further, the upper cushion portion 24 includes a plurality of leg portions downwardly increasing their thickness on the inside of the top surface 24*a*. The lid of the packing box contacts with the tips of these leg portions 32.

Figure 9B:
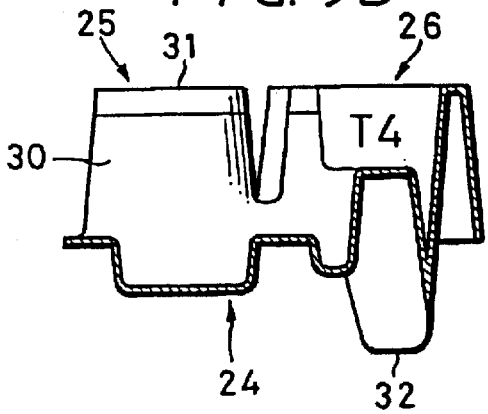
FIG. 9B is a cross-sectional view taken along the line X—X in FIG. 7.
Figure 9C:
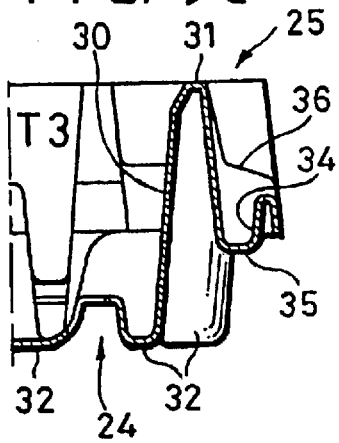
FIG. 9C is a cross-sectional view taken along the line Y—Y in FIG. 7

The protrusion portion 31 of the first side cushion portion 25 erects on one side of the upper cushion portion 24 and the surface of the front side that contacts with the packed article forms a contact surface 30 of a flat surface so that it can contact with the side surface of the packed article in a wide range as shown in FIG. 9B and so on. The protrusion portion 31 has a reinforcement portion 22 formed on the rear side thereof, and the reinforcement portion 33 has the recess portion 34 which shows the first specific example of concave and convex portions. A cylindrical thick portion 35 is provided on the rear side of the protrusion portion 31 to form this recess portion 34 as shown in FIG. 9A.

Further, as shown in FIG. 4, the protrusion portion 31 has a reinforcement rib 36 formed on the rear side thereof by slightly bulging out the root portion. A transformation area 37 shown hatched in FIG. 3 is a portion which compresses itself and change in shape in response to external force acting on this side surface from the side portion in an accident such as when a packed article is dropped unintentionally. The second side cushion portion 26 includes a rib portion 38 and a convex portion 39 which position a packed article. The rib portion 38 and the convex portion 39 are set to be low so that their contact surfaces may contact with the lower portion of the packed article. Consequently, the packed article can be securely supported at the predetermined position.

Figure 5:
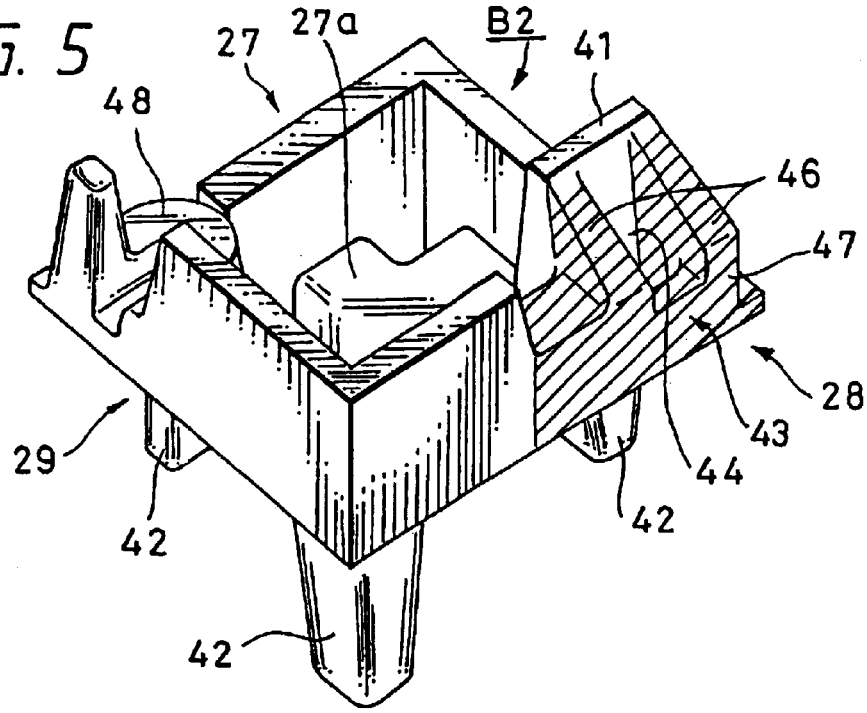
FIG. 5 is a perspective view showing a packing cushion material according to a third embodiment of the present invention and illustrates the packing cushion material from one of the front in which a packed article is housed.
Figure 6:
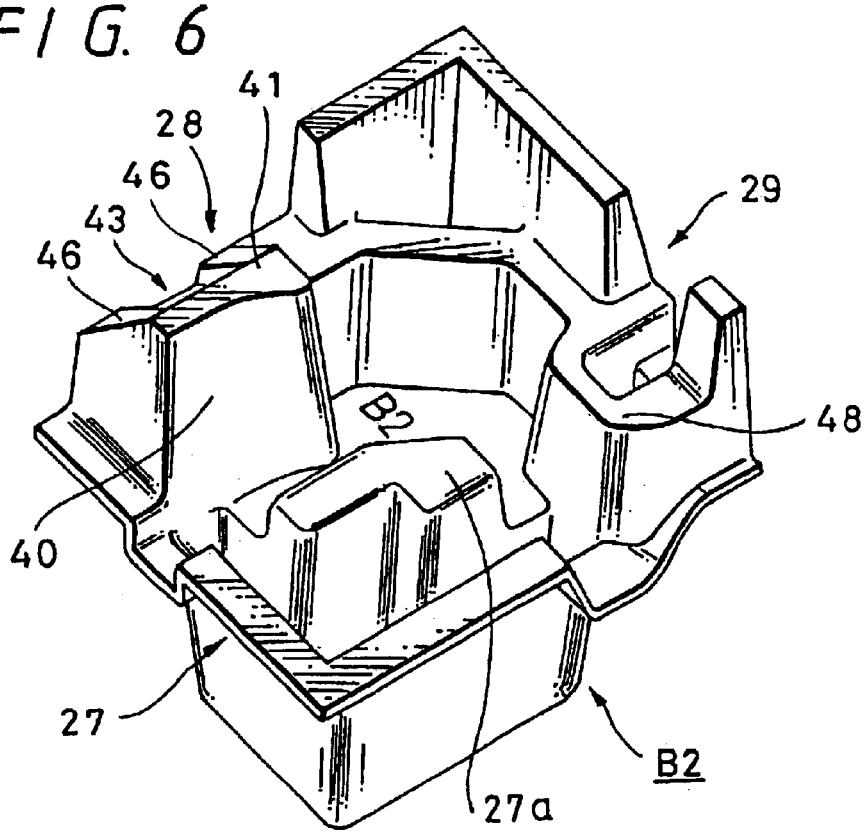
FIG. 6 is a perspective view showing a packing cushion material according to a third embodiment of the present invention and illustrates the packing cushion material from the other side of the front in which a packed article is housed.

FIGS. 5 and 6 show the second packing cushion material B2 of the bottom cushion materials B1 to B4 and illustrate the surface side that contacts with the packed article from two directions. Specifically, as shown in FIG. 6, one place of the lower corner portion of the packed article is attached to the central portion of the second packing cushion material, the bottom surface of the packing box is opposed to the lower surface, not shown, and the side surface of the packing box is opposed to the rear side (back side).

The second packing cushion material B2 comprises a lower cushion portion 27 including a placement surface 27*a* on which a packed article is placed, a first side cushion portion 28 continuing to one side of this lower cushion portion 27 and which includes a protrusion portion 41 and a second side cushion portion 29 located at the position that is rotated by 90 degrees in the clockwise direction relative to the first side cushion portion 28 in FIG. 7 and which continues to the other side of the lower cushion portion 27. The placement surface 27*a* of the lower cushion portion 27 can be shaped freely so long as it is a flat surface that can contact with the lower surface of the packed article. Further, the lower cushion portion 27 includes a plurality of leg portions 42 which downwardly increase their thicknesses inside the placement surface 27*a*, and the bottom surface of the packing box contacts with the tips of these leg portion 42.

Figure 9D:
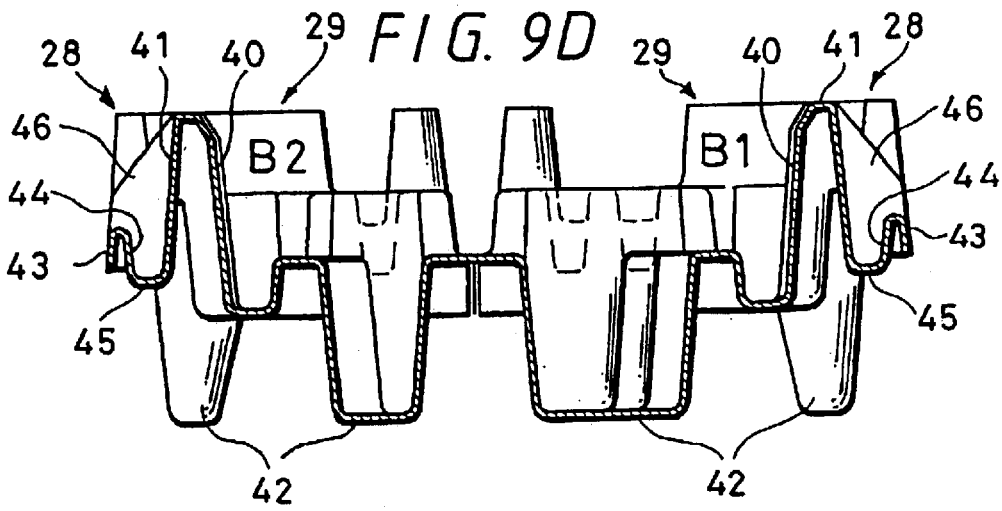
FIG. 9D is a cross-sectional view taken along the Z—Z in FIG. 7.

The protrusion portion 41 of the first side cushion portion 28 erects on one side of the lower cushion portion 27, and the surface of the front side that contacts with the packed article forms a contact surface 40 of a curved surface that can contact with the side surface of the packed article in a wide range as shown in FIG. 6. This protrusion portion 41 has a reinforcement portion 43 formed on the rear side thereof. The reinforcement portion 43 includes a recess portion 44 which shows a specific example of concave and convex portions similarly to the fourth packing cushion material T4 and the like. This recess portion 44 comprises a cylindrical thick portion 45 formed on the rear side of the protrusion 41 as shown in FIG. 9D.

Further, the protrusion portion 41 has a reinforcement rib 46 formed on the rear side thereof by bulging out the top portion to the root portion. A transformation area 47 shown by hatching in FIG. 5 can change in shape like contracting in response to external force acting on this side surface from the lateral direction in an accident such as when a packed article is dropped unintentionally. When the transformation area 47 compresses itself in response to external force, the external force is transformed into thermal energy, whereby shocks can be absorbed and cushion function can be demonstrated sufficiently.

On the other hand, since the protrusion portion 41 serving as the inside of the transformation area 47 is formed as a wall whose shape is difficult to collapse, this protrusion portion 41 can support the packed article with high stability and it is possible to prevent external force from being directly transmitted to the packed article. In addition, since the contact surface 40 has a large area which contacts with the packed article, vibrations transmitted to the packed article can be attenuated effectively. Thus, the paints can be prevented from being peeled off from the surface of the packed article and the surface of the packed article can be prevented from being scratched.

The second side cushion portion 29 includes a semi-cylindrical regulating portion 48 for positioning a packed article. This regulating portion 48 is set to be low so that its contact surface may contact with the lower portion of the packed article. Thus, the packed article can be securely supported at the predetermined position.

Figure 10A:
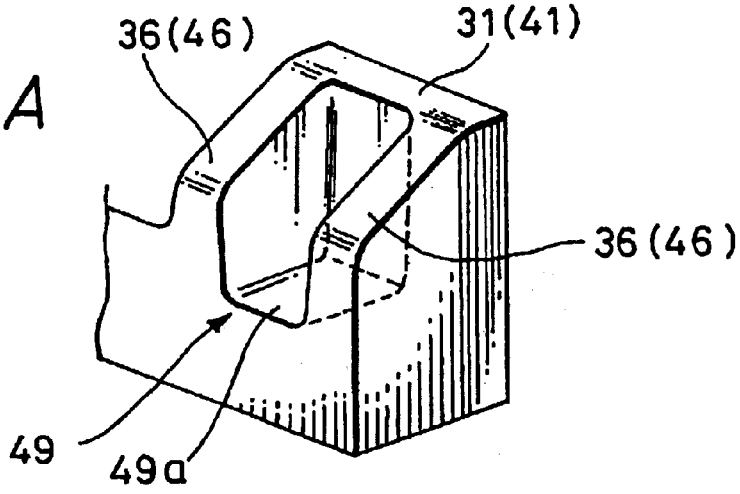
FIG. 10A is a perspective view of a reinforcement portion according to a second embodiment.
Figure 10B:
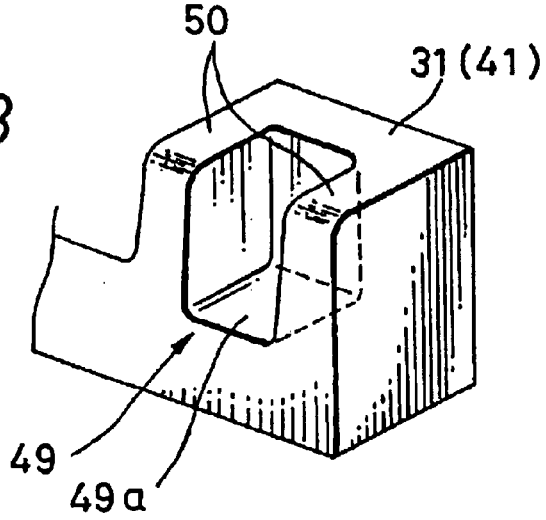
FIG. 10B is a perspective view of a reinforcement rib according to a second embodiment and FIG. 10C is a perspective view of a reinforcement portion and a reinforcement rib according to a third embodiment, respectively.

FIGS. 10A, 10B, 10C and FIGS. 11A, 11B, 11C show the concave portion and the convex portion formed on the above-mentioned reinforcement portions 33, 43 and the reinforcement ribs 36, 46 according to another embodiment. Specifically, FIG. 10A shows the concave portion and the convex portion of the reinforcement portion according to a second embodiment, wherein a surface 49*a* of a reinforcement portion 49 is located at the position lower than the root of the reinforcement rib 36 (or 46). The reinforcement portion 49 can increase strength of up to the protrusion portion 31 (or 41) to improve cushion function of the side cushion portion. FIG. 10B shows a modified example of the reinforcement rib 36 (46) shown in FIG. 10A. The reinforcement rib 50 according to the second embodiment is formed as a square wall surface.

Figure 10C:
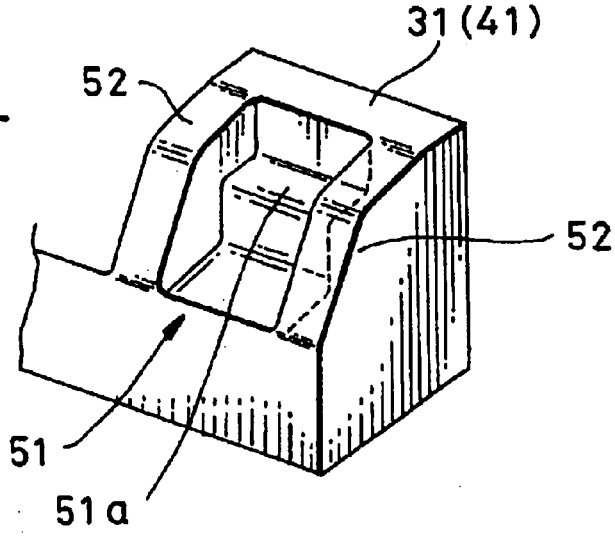

FIG. 10C shows the reinforcement portion and the reinforcement rib according to a third embodiment. This reinforcement portion 51 comprises a stairs-like convex portion 51*a* formed at the root of the protrusion portion 31 (or 41). The convex portion 51*a* continues in the direction parallel to the protrusion portion 31 (or 41). The reinforcement rib 52 has inclined portions formed at the root side and the top portion side thereof.

Figure 11A:
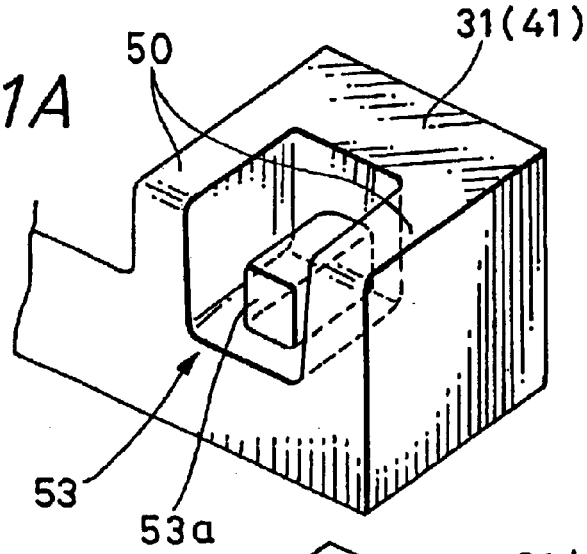
FIG. 11A is a perspective view of a reinforcement portion according to a fourth embodiment.

FIG. 11A shows a concave portion and a convex portion of a reinforcement portion according to a fourth embodiment. This reinforcement portion 53 comprises a bank-like convex portion 53 formed at the root of the protrusion portion 31 (or 41). The convex portion 53*a* continues in the direction perpendicular to the protrusion portion 31 (or 41). The reinforcement portion 51 or 53 including such convex portion 51*a* or 53*a* can reinforce the root portion of the protrusion 31 (or 41).

Figure 11B:
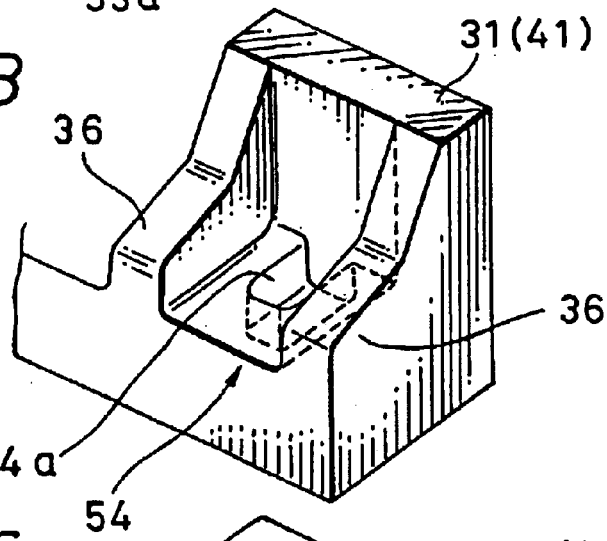
FIG. 11B is a perspective view of a reinforcement portion according to a fifth embodiment and FIG. 11C is a perspective view of a reinforcement portion and a reinforcement rib according to a sixth embodiment, respectively.

FIG. 11B shows a concave portion and a convex portion of a reinforcement portion according to a fifth embodiment. This reinforcement portion 54 comprises a groove-like concave portion 54*a* formed at the root of the protrusion portion 31 (or 41). The concave portion 54*a* continues in the direction perpendicular to the protrusion portion 31 (or 41).

Figure 11C:
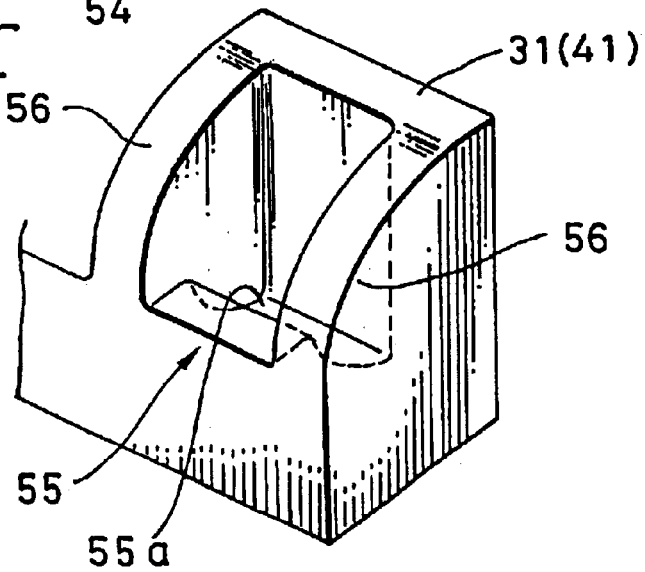

FIG. 11C shows a concave portion and a convex portion of a reinforcement portion according to a sixth embodiment. This reinforcement portion 55 comprises a groove-like concave portion 55*a* formed at the root of the protrusion portion 31 (or 51). The concave portion 55*a* is shaped like a groove that forms a quarter of a cylinder and continues in the direction parallel to the protrusion 31 (or 41). The reinforcement portion 54 or 55 including such concave portion 54*a* or 55*a* can reinforce the root portion of the protrusion portion 31 (or 41).

Figure 12:
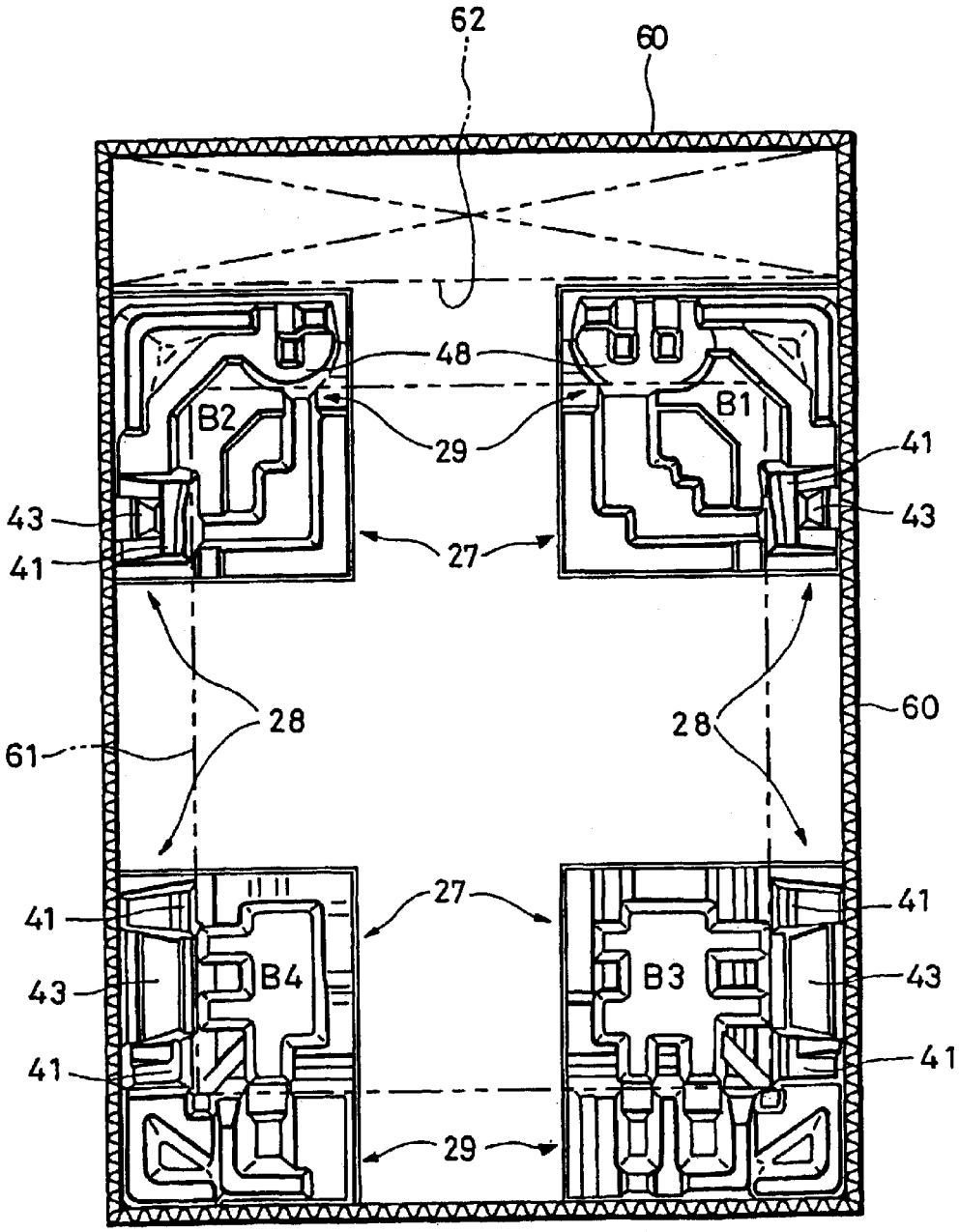
FIG. 12 is an explanatory diagram showing the manner in which a packing cushion material according to the present invention is in use and illustrates the state in which four bottom cushion materials are housed in a packing box.
Figure 13:
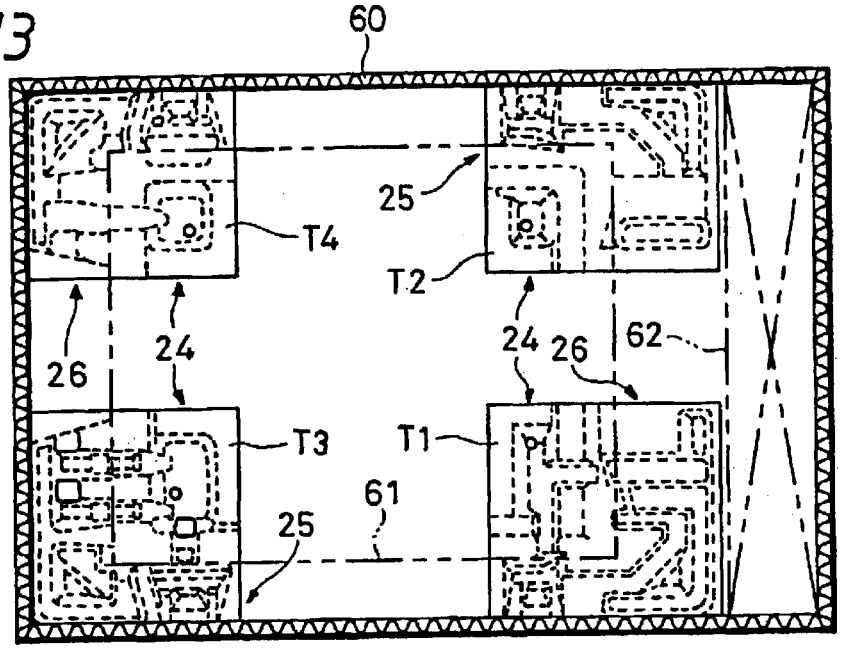
FIG. 13 is an explanatory diagram showing the manner in which a packing cushion material according to the present invention is in use and showing the state in which four top cushion material are housed in a packing box.
Figure 14:
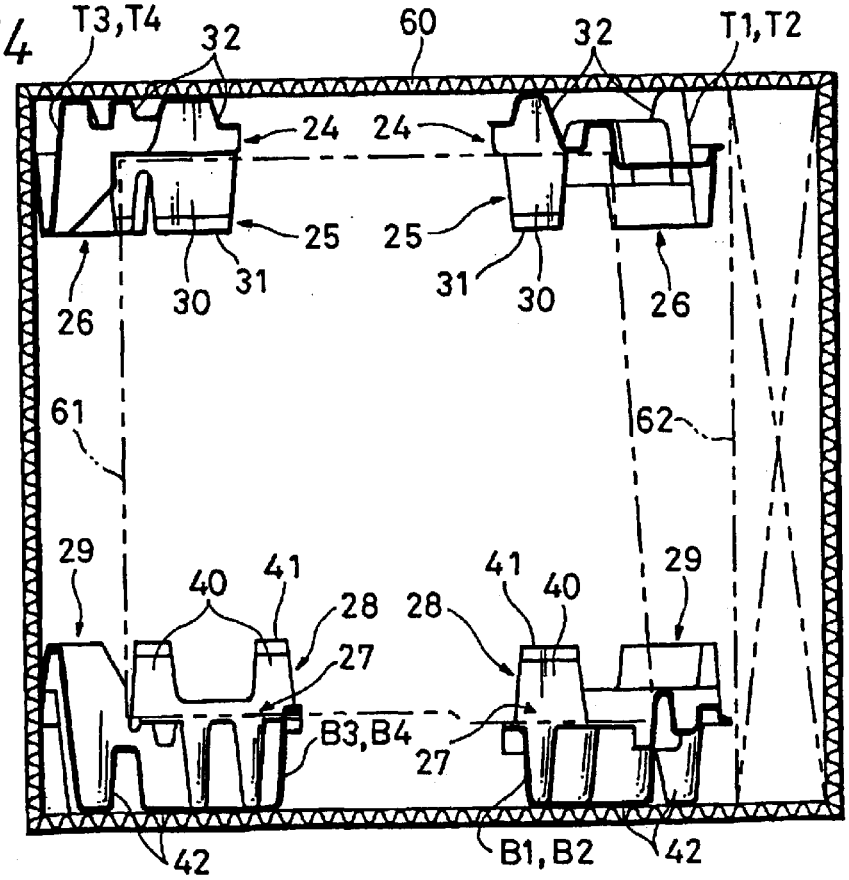
FIG. 14 is an explanatory diagram showing, in a cross-sectional fashion, the state in which a packed article is held by the packing cushion materials according to the present invention.
Figure 15:
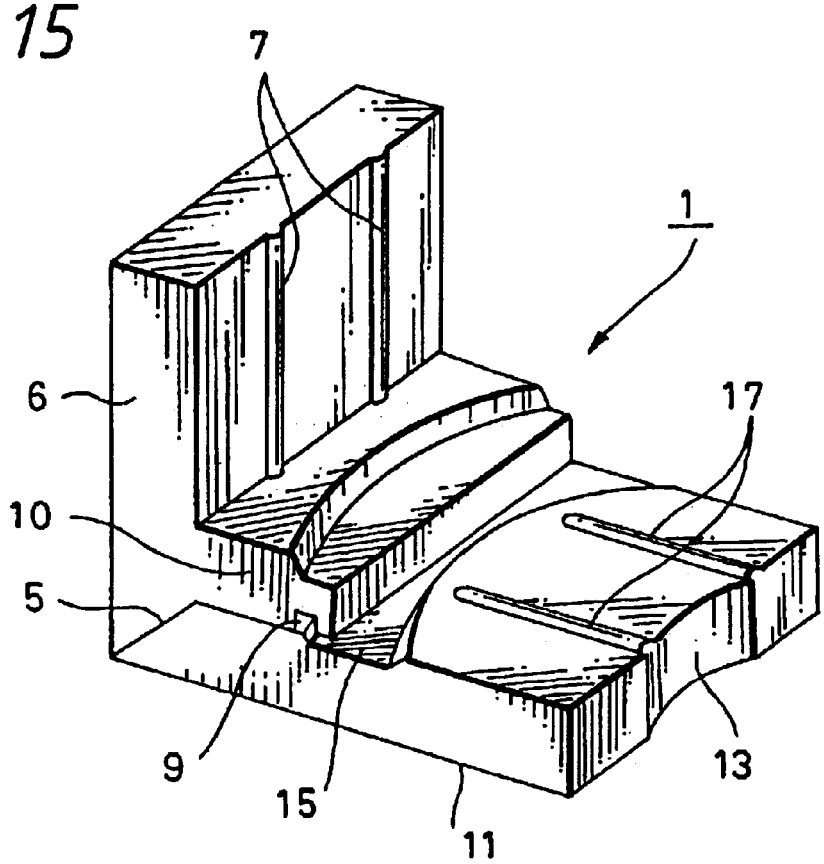
FIG. 15 is a perspective view showing a conventional packing cushion material.
Figure 16:
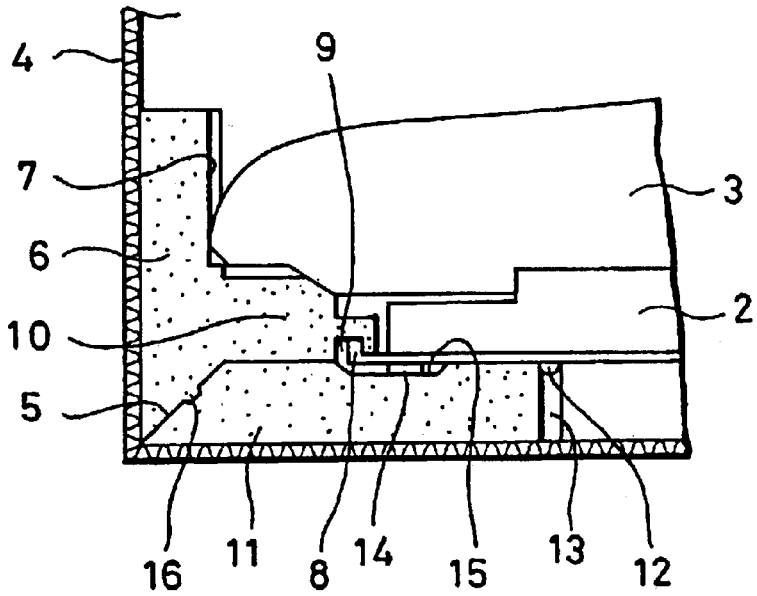
FIG. 16 is an explanatory diagram showing the state in which an article is supported by a conventional packing cushion material.

The eight packing cushion materials T1 to T4 and B1 to B4 having the above arrangements can be used as shown in FIGS. 12, 13 and 14, for example. In the sheets of drawings, reference numeral 60 denotes a packing box made with a suitable material such as a corrugated cardboard. Reference numeral 61 denotes a packed article which is an object to be packed.

Articles whose outward appearance shapes are cube-like shapes, such as audio apparatus, television receivers, speaker apparatus, video tape recorders, CD players and DVD players are suitable as the packed article 61. The present invention, however, can be applied to packing of electronic appliances and household utensils having various outward appearance shapes other than the cube-like shape and packing of various articles. Reference numeral 62 denotes an accessory available in relation to the packed article 61.

FIG. 12 shows the state in which the four bottom cushion materials B1 to B4 and the accessory 62 are disposed on the bottom of the packing box 60. The accessory 62 is housed within the packing box 60 on one side of the longitudinal direction along the vertical direction. The first bottom cushion material B1 and the second cushion material B2 are located at the two corners at which the accessory 62 is located. The third bottom cushion material B3 and the fourth cushion material B4 are located at the two corners of the opposite side. Then, the packed article 61 is housed at the central portion of the four bottom cushion materials B1 to B4, and the four corners of the packed article 61 are upwardly supported by the four bottom cushion materials B1 to B4, respectively.

FIG. 13 shows the state in which the four top cushion materials T1 to T4 are attached to the packed article housed within the packing box 60. An upper lid of the packing box 60 is put on the top cushion materials T1 to T4 and sealed. Thereafter, the butting portions of the upper lid are fastened by a suitable means such as an adhesive tape and the packing process is completed so that the packed article 61 and the accessory 62 are housed within the packing box 60. FIG. 14 is a diagram showing this packing state along the longitudinal direction in a cross-sectional fashion.

As is clear from FIG. 14, the respective protrusion portions 31, 41 of totally eight packing cushion materials T1 to T4 and B1 to B4 oppose respective side surfaces of the upper portion and the lower portion of the packed article 61 and their contact surfaces 30, 40 are brought in contact with the side surfaces of the packed article 61. Therefore, the packed article 61 can be held with high stability.

When several packing boxes 60 thus packed are stacked in order to keep them in a suitable storage place such as a warehouse, although the weights of the packing boxes 60 in the upper layers are applied to the packing boxes 60 in the lower layers, the weights are applied to the packed article 61 through the four top cushion materials T1 to T4 and the four bottom cushion materials B1 to B4.

In that case, when vibration loads are applied to the packing box 60, for example, since the contact surfaces 30, 40 provided on the protrusion portions 31, 41 are brought in contact with the side surfaces of the packed article 61, the contact surfaces 30, 40 can receive such vibration loads and can disperse these vibration loads throughout the wide contact surfaces. Therefore, it is possible to prevent the side surfaces of the packed article 61 and the contact surfaces 30, 40 from strongly rubbing against each other. Consequently, the occurrence of trouble such as when the paint are peeled off from the packed article 61 or the packed article is scratched can be suppressed or prevented. In addition, since the protrusion portions 31, 41 have the reinforcement portions 33, 43 formed on the rear sides, buffering function can be demonstrated sufficiently. Thus, even though shocks are applied to the packing box in an accident such as when the packing box is dropped unintentionally, such shocks can be buffered and the packed article 61 can be protected effectively.

As described above, the present invention is not limited to the above-mentioned embodiments. For example, while the four top cushion materials and the four bottom cushion materials are provided and are used to support the packed article from the upper and lower directions as described above, it is sufficient that at least two top cushion materials and two bottom cushion materials may be provided. It is also needless to say that two or three cushion materials can be formed as a set or that more than five cushion materials can be formed as a set. Moreover, the materials of packing boxes need not of course be limited to the above-mentioned corrugated cardboards.

As described above, the present invention can be variously modified without departing from the gist of the present invention.

Industrial Applicability

According to the packing cushion material of the present application, the packing cushion material can be molded by pulp mold of a relatively small amount. Although this packing cushion material is small in size, this packing cushion material can demonstrate a high buffering capability, can protect packed articles softly and can prevent the paints from being peeled off from the packed article and can prevent the packed article from being scratched.

What is claimed is:

1. A package made of pulp material for absorbing an external force applied to a solid object accommodated in a box, comprising:

a first pad having at least a point of contact with a top surface of said solid object when said object and said first pad are arranged within said box;

a second pad having at least a point of contact with a bottom surface of said solid object when said object and said second pad are arranged within said box;

wherein each of said first pad and second pad has:

a vertical force-absorbing section for absorbing an external force acting vertically to said box; and a lateral force-absorbing section for absorbing an external force acting laterally to said box; and said lateral force-absorbing section has;

a protruding section protruding in a vertical direction and having a surface of contact with said object, when said object and respective first or second pad is arranged within said box; and a reinforcement section formed by protrusions and a recess on a reverse side of said protruding section, said reverse side comprising a surface which is reverse with respect to the surface which has contact with the object arranged within said box, said reinforcement section has a surface which is in a lower position than root portions of said protruding section, when the object is arranged within said box.

2. The packing system according to claim 1, wherein said protruding section has a reinforcement rib protruding to an outside of the packing.

3. The packing system according to claim 1, wherein said reinforcement section includes a portion expanded from an opposite side of the direction in which said protruding portion protrudes.

4. The packing system according to claim 1, wherein said reinforcement section includes a portion expanded from a rear of said protruding portions.

5. A shock-absorbing pad for absorbing an external force applied to a solid object accommodated in a box, comprising:

a contact section having contact with a surface of said solid object when said object and said pad are arranged within said box;

a vertical force-absorbing section for absorbing an external force acting vertically to said box; and a lateral force-absorbing section for absorbing an external force acting laterally to said box;

wherein said lateral force-absorbing section has:

a supporting section having a protrusion protruding in a vertical direction, the protrusion having a surface of contact with said object when said object and said pad is arranged within said box; and a reinforcement section formed by protrusions and a recess on a reverse side of said protruding section, said reverse side compromising a surface which is reverse with respect to the surface which has contact with the object arranged within said box wherein said reinforcement section is formed as a surface lower then root portions of said protruding section.

6. A shock absorbing pad for absorbing an external force applied to packed solid object accommodated in a box comprising:

a holding member; a reinforcement member and a deforming member; wherein said holding member comprises a protruding section of the shock absorbing pad having one of its sides constituting an area of contact with the solid object when said pad is positioned in said box between said solid object and an internal wall of said box, wherein:

said reinforcement member has protrusions and a recess and is positioned in a reverse side of said holding member in relation to a side that constitutes the area of contact with the solid object;

said deforming member comprises at least a rib constituted by a protrusion formed on one of the sides of said protruding section of said holding member and opposite to the side that constitutes the contacting area of the holding member; and said deforming area absorbs external force applied to said box by deforming said rib in reaction to said external force so that the vertical force does not act on said solid object wherein said reinforcement section is formed as a surface lower then root portions of said protruding section.

7. The pad according to claim 6, wherein said protrusion of said enforcement member absorbs an external force applied vertically over said box, so that the vertical force does not act on said solid object.

* * * * *